US011140947B2

(12) United States Patent
Chen

(10) Patent No.: US 11,140,947 B2
(45) Date of Patent: Oct. 12, 2021

(54) INSERTING BUCKLE

(71) Applicant: Dongguan Jiasheng Enterprise Co., Ltd, Guangdong (CN)

(72) Inventor: Silong Chen, Guangdong (CN)

( * ) Notice: Subject to any disclaimer, the term of this patent is extended or adjusted under 35 U.S.C. 154(b) by 0 days.

(21) Appl. No.: 16/843,911

(22) Filed: Apr. 9, 2020

(65) Prior Publication Data

US 2021/0161255 A1 Jun. 3, 2021

(30) Foreign Application Priority Data

Nov. 30, 2019 (CN) ..... 201911208070.5

(51) Int. Cl.
*A44B 11/26* (2006.01)
*A44B 11/25* (2006.01)

(52) U.S. Cl.
CPC ..... *A44B 11/266* (2013.01); *A44B 11/2519* (2013.01); *A44B 11/2592* (2013.01)

(58) Field of Classification Search
CPC ..... A44B 11/266; A44B 11/2519; A44B 11/2592
See application file for complete search history.

(56) References Cited

U.S. PATENT DOCUMENTS 2,847,748 A * 8/1958 Robinton ..... B64D 17/32 24/648
4,313,246 A * 2/1982 Fohl ..... A44B 11/2523 24/635
6,965,231 B1 * 11/2005 Cinoglu ..... A61B 5/055 324/300
8,181,319 B2 * 5/2012 Johnson ..... A44B 11/253 24/648
9,521,882 B2 * 12/2016 Hung ..... A44B 11/263
9,560,898 B2 * 2/2017 Hortnagl ..... A44B 11/2592
10,010,141 B2 * 7/2018 Hung ..... A44B 11/2546
2002/0184742 A1 * 12/2002 Casebolt ..... A44B 11/253 24/634
2006/0048350 A1 * 3/2006 Coulombe ..... A44B 11/253 24/634
2010/0071173 A1 * 3/2010 Hortnagl ..... A44B 11/2592 24/651

* cited by examiner

*Primary Examiner* — David M Upchurch

(57) ABSTRACT

An inserting buckle includes an insertion piece, a buckle body, an ejection member, a first pressing buckle and a second pressing buckle. The second pressing buckle movably disposed in the cavity and moved toward or away from the first pressing buckle; the second pressing buckle is driven back by a second elastic member; a buckle hole is formed between the first pressing buckle and the second pressing buckle; the connection portion is inserted into the cavity and is locked in the buckle hole; the first pressing buckle and the second pressing buckle are simultaneously pressed to enlarge an width of the buckle hole, the connection portion is separated from the buckle hole, the ejection member ejects the connection portion out of the cavity. The operation of separating the buckle body and the insertion piece only needs to simultaneously press the first button and the second button with one hand.

16 Claims, 6 Drawing Sheets

INSERTING BUCKLE

TECHNICAL FIELD

The present invention relates to connecting buckle technical field, and more particularly, to an inserting buckle. This application claims the benefit of priority from Chinese application No. CN201911208070.5, filed on Nov. 30, 2019. The content of the aforementioned application is incorporated by reference.

BACKGROUND

Inserting buckle is used to fasten two objects. The inserting buckle has so many uses, for example, it is used on belt, pet belt, safety belt, etc.

The inserting buckle in the prior art consists of an insertion piece and a buckle part. Both sides of the buckle part is integrally formed with an elastic arm, respectively. The insertion piece is hollow structure, both side walls of the insertion piece are provided with a buckle hole. When the insertion piece connects with the buckle part, the buckle part inserts into the insertion piece, two elastic arms are locked with two buckle holes, respectively. When the insertion piece is separated from the buckle part, user presses two elastic arms with one hand and pulls the buckle part out of the insertion piece with the other hand. Hence, this kind of inserting buckle must be operated with both hands at the same time to separate the insertion piece and the buckle part, which is not convenient to use.

SUMMARY

The object of the invention is to provide an inserting buckle, which aims to solve the technical problem of the prior art, which requires the simultaneous operation with both hands in order to separate the insertion piece and the buckle part and is not convenient to use.

In order to achieve the aforementioned object, the invention provides an inserting buckle, which includes an insertion piece with a connection portion:

The inserting buckle also includes a buckle body, an ejection member, a first pressing buckle and a second pressing buckle.

The buckle body has a cavity inside; the buckle body is provided with an insertion opening matched with the connection portion, the insertion opening is communicated with the cavity.

The ejection part is fixedly installed in the cavity and pointing at its inner surface of the insertion opening; when the connection portion is inserted into the cavity, the ejection part contacts with it.

The first pressing buckle is movably disposed in the cavity and driven back by a first elastic member; and the second pressing, buckle is movably disposed in the cavity and moved toward or away from the first pressing buckle; the second pressing buckle is driven back by a second elastic member; a buckle hole is formed between the first pressing buckle and the second pressing buckle; the connection portion is inserted into the cavity and is locked in the buckle hole; the first pressing buckle and the second pressing buckle are simultaneously pressed to enlarge, its width of the buckle hole, the connection portion is separated from the buckle hole, the ejection member ejects the connection portion out of the cavity; when the first pressing buckle and the second pressing buckle are released, the first elastic member drives the first pressing buckle back, the second pressing buckle drives the second pressing buckle back, its width of the buckle hole is recovered.

Preferably, the first pressing buckle includes a first button and a first buckle member; the first buckle member includes a first sliding plate, a first stopper and a first connecting part; the first sliding plate is movably mounted inside the cavity, the first stopper is fixed on one end of the first sliding plate, the first connecting part is fixed on the other end of the first sliding plate; the second pressing buckle includes a second button and a second buckle portion, the second buckle member is inversely arranged on the first buckle member; the second buckle member includes a second sliding plate, a second stopper and a second connecting part; the second sliding plate is movably mounted inside the cavity, the second stopper is fixed on one end of the second sliding plate, the second connecting part fixed on the other end of the second sliding plate.

Preferably, the first stopper, the second connecting part, the first connecting part and the second stopper are sequentially arranged; the first stopper is movably mounted on its sidewall of the cavity, the first button is fixed on the first stopper and passes through its sidewall of the cavity; the second stopper is movably mounted on its opposite sidewall of the cavity, the second button is fixed on the second stopper and passes through its opposite sidewall of the cavity; one end of the first elastic member is joined to the first stopper, the other end of the first elastic member is joined to the second connecting part; one end of the second elastic member is joined to the second stopper, the other end of the second elastic member is joined to the first connecting part; the buckle hole is formed between the first connecting part and the second connecting part; the connection portion is inserted into the buckle hole by passing through the insertion opening and is locked by the first connecting part and the second connecting part; the first button and the second button are simultaneously pressed, the first buckle member and the second buckle are moved away from each other, its width of the buckle hole is enlarged, the connection portion is separated from the first connecting part and the second connecting part.

Preferably, the connection portion is provided with a first buckle groove on its one side and a second buckle groove on its other side, both of the first buckle groove and the second buckle groove have a plane and an inclined plane, the plane is perpendicular to its side edge of the connection portion; an angle is formed between the inclined plane and the plane.

Preferably, its internal surface of the first connecting part is provided with a first buckle bulge portion matching with the first buckle groove; its internal surface of the second connecting part is provided with a second bulge portion matching with the second buckle groove.

Preferably, its inside surface of the first stopper is provided with a first positioning column, its outside surface of the second connecting part is provided with a second positioning column, one end of the first elastic member is sleeved on the first positioning column, the other end of the first elastic member is, sleeved on the second positioning column; its inside surface of the second stopper is provided with a third positioning column, its outside surface of the first buckle member is provided with a fourth positioning column, one end of the second elastic member is sleeved on the third positioning column, the other end of the second elastic member is sleeved on the fourth positioning column.

Preferably, its two opposite side walls of the buckle body are provided with a first button hole and a second button hole, respectively; the first button passes through the first button hole, the first stopper is limited in its inner side of the first button hole; the second button passes through the second button hole, the second stopper is limited in its inner side of the second buttonhole.

Preferably, the buckle body includes a casing and a bottom cover, its bottom of the casing is provided with an opening, the bottom cover is covered on the opening, the bottom cover is provided with a positioning column for installation on its internal surface, the casing is provided with a positioning hole matching with the positioning column for installation.

Preferably, its periphery of insertion opening is provided with a guiding bump; the connection portion is provided with a guiding groove matching with the guiding bump.

Preferably, both sides of the connection portion are provided with a circular portion, respectively.

One or more of the technical schemes in the inserting buckle provided in the embodiments of the invention have at least one of the following technical effects: When the inserting buckle is used, the connection portion is inserted into the cavity and connected with the buckle hole, the buckle part is locked with the inserting piece. When the first button and the second button are simultaneously pressed, the width of the button hole is increased, the connecting portion is separated from the button hole, and the ejection part drives the connecting portion to eject out of the cavity. The operation of separating the buckle part and the insertion piece only needs to simultaneously press the first button and the second button with one hand, the ejection part will automatically eject the buckle part, which is convenient and high practicability.

BRIEF DESCRIPTION OF THE DRAWINGS

In order to better illustrate the technical scheme in the embodiment of the invention, the following will give a brief description of the drawings to be used in the embodiments or the prior art. It is obvious that the drawings in the following description are only some embodiments of the invention, and for the general technical personnel of the field, other drawings can be obtained on the basis of the drawings without creative effort.

DETAILED DESCRIPTION OF EMBODIMENTS

Figure 1:
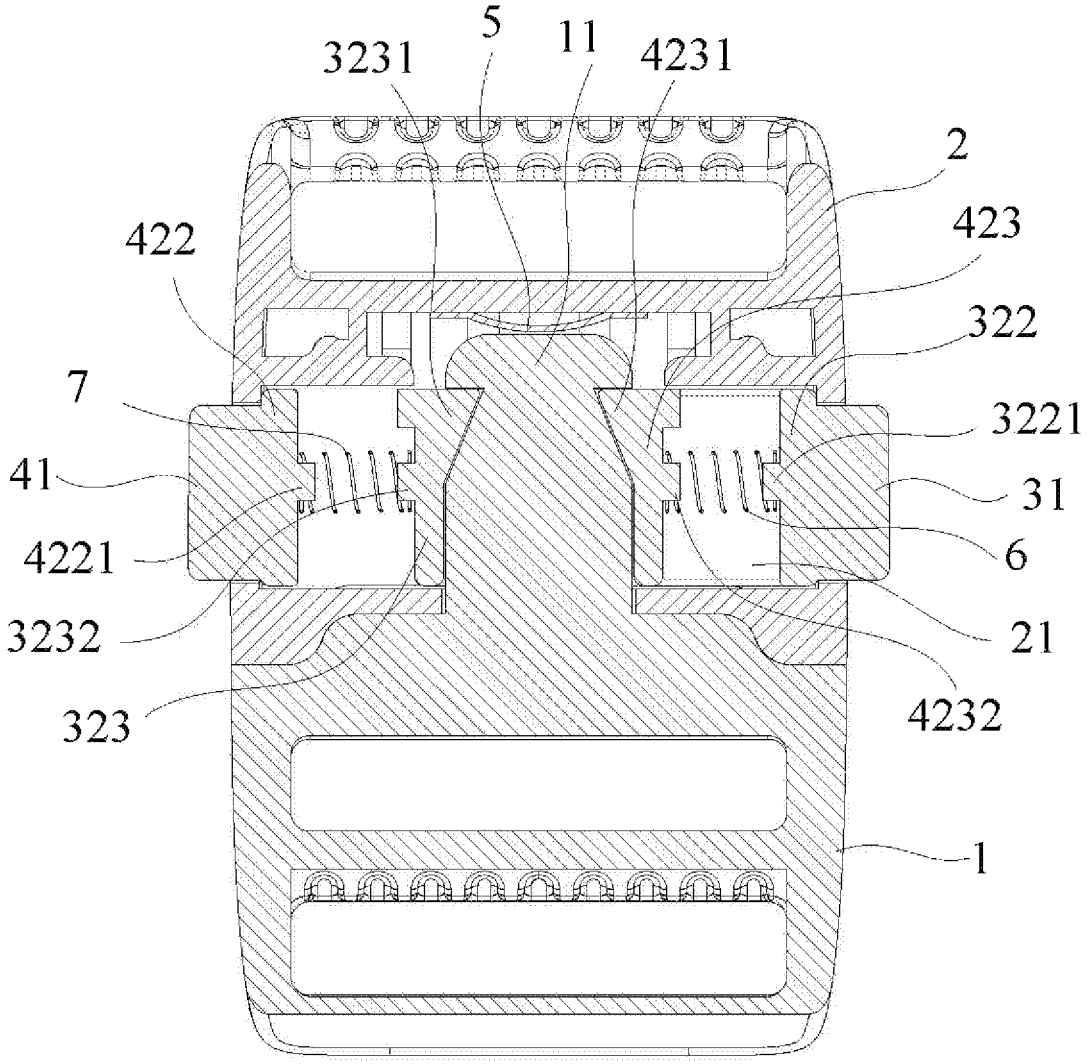
FIG. 1 shows a sectional view of the inserting buckle according to a preferred embodiment in present invention.

The embodiments in the present invention are described in detail below, and examples of the embodiments are shown in the drawings where the same or similar labels from beginning to end represent the same or similar elements or elements with the same or similar functions. The embodiments described below by reference to the drawings are exemplary and designed to explain the embodiments of the invention and cannot be understood as limitations on the invention.

As shown in FIG. 1 to FIG. 6, a preferred embodiment in the present invention discloses an inserting buckle, which includes an insertion piece 1 with a connection portion 11, a buckle body 2, an ejection member 5, a first, pressing buckle 3 and a second pressing buckle 4.

The connection relationship between the connection portion 11 and the buckle body 2 could be integrated forming, welding, threaded connection, riveting, etc.

The buckle body 2 has a cavity 21 inside. The buckle body 2 is provided with an insertion opening 211 matched with the connection portion 11, the insertion opening 211 is communicated with the cavity 21.

The ejection member 5 is fixedly installed in the cavity 21 and pointing at its inner surface of the insertion opening 211. When the connection portion 11 is inserted into the cavity 21, the ejection member 5 contacts with it. Specifically, the ejection member 5 is an arc-shaped elastic sheet.

The first pressing buckle 3 is movably disposed, in the cavity 21 and driven back by a first elastic member 6. Specifically, the first elastic member 6 is spring.

The second pressing buckle 4 is movably disposed in the cavity 21 and moved toward or away from the first pressing buckle 3. The second pressing buckle 4 is driven back by a second elastic member 7. Specifically, the second elastic member 7 is spring. A buckle hole 212 is formed between the first pressing buckle 3 and the second pressing buckle 4. The connection portion 11 is inserted into the cavity 21 and is locked in the buckle hole 212. The first pressing buckle 3 and the second pressing buckle 4 are simultaneously pressed to enlarge its width of the buckle hole 212, the connection portion 11 is separated from the buckle hole 212, the ejection member 5 ejects the connection portion 11 out of the cavity 21. When the first pressing buckle 3 and the second pressing buckle 4 are released, the first elastic member 6 drives the first pressing buckle 3 back, the second pressing buckle 4 drives the second pressing buckle 4 back, its width of the buckle hole 212 is recovered.

When the inserting buckle is used, the connection portion 11 is inserted into cavity 21 and connected with the buckle hole 212, the buckle body 2 is, locked with the insertion piece 1. When the first pressing buckle 3 and the second pressing buckle 4 are simultaneously pressed, its width of the buckle hole 212 is increased, the connection portion 11 is, separated from the buckle hole 212, the ejection member 5 ejects the connection portion 11 out of the cavity 21. The operation of separating the buckle body 2 and the insertion piece 1 only needs to press the first pressing buckle and the second pressing buckle simultaneously with one hand, the ejection member 5 ejects the connection portion 11 out of the cavity 21 automatically, which has the advantages of convenient operation and strong practicability.

Figure 2:
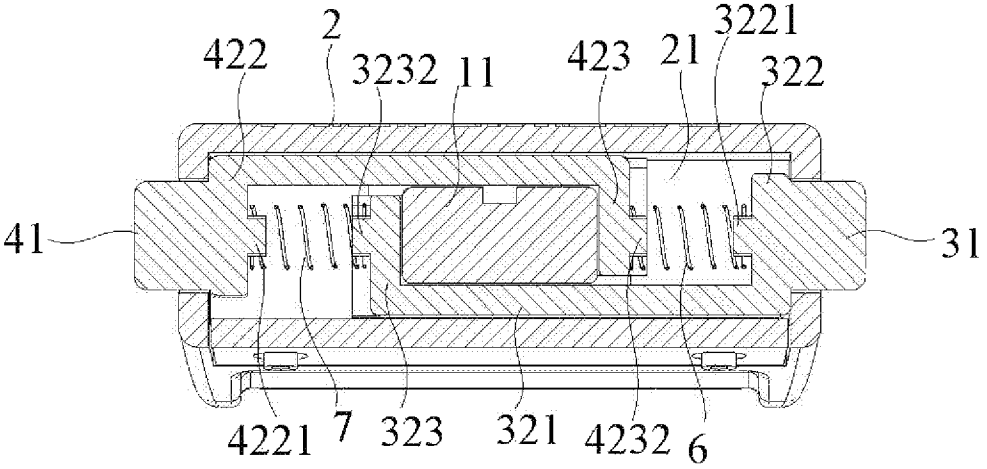
FIG. 2 shows the other sectional view of the inserting buckle according to a preferred embodiment in present invention.
Figure 3:
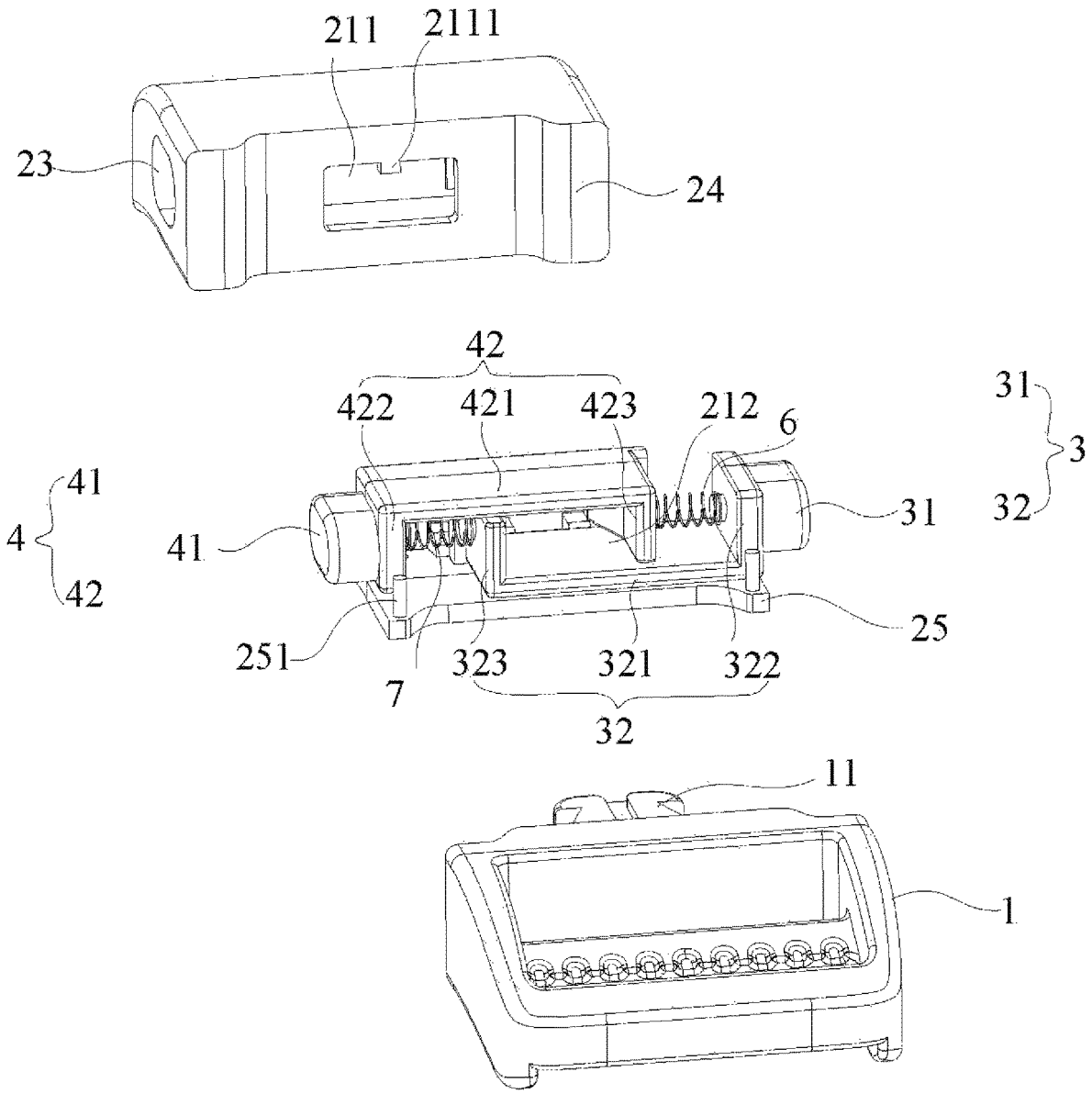
FIG. 3 shows an exploded view of the inserting buckle according to a preferred embodiment in present invention.

As shown in FIG. 1 to FIG. 3, in another embodiment in the present invention, the first pressing buckle 3 includes a first button 31 and a first buckle member 32. The first buckle member 32 includes a first sliding plate 321, a first stopper 322 and a first connecting part 323. Specifically, the first sliding plate 321, the first stopper 322 and the first connecting part 323 are plate-like structure. The first sliding plate 321 is movably mounted inside the cavity 21, the first stopper 322 is fixed on one end of the first sliding plate 321, the first connecting part 323 is fixed on the other end of the first sliding plate 321. The second pressing buckle 4 is inversely arranged on the first pressing buckle 3. The second pressing buckle 4 includes a second button 41 and a second buckle member 42. The second buckle member 42 includes a second sliding plate 421, a second stopper 422 and a second connecting part 423. Specifically, the second sliding plate 421, the second stopper 422 and the second connecting part 423 are plate-like structure. The second sliding plate 421 is movably mounted inside the cavity 21, the second stopper 422 is fixedly installed on one end of the second sliding plate 421, the second connecting part 423 fixedly installed on the other end of the second sliding plate 421.

As shown in FIG. 1 to FIG. 3, in another embodiment of the present invention, the first stopper 322, the second connecting part 423, the first connecting part 323 and the second stopper 422 are sequentially arranged. The first stopper 322 is movably mounted on its sidewalls of the cavity 21, the first button 31 is fixedly installed on the first stopper 322 and passes through its sidewalls of the cavity 21, The second stopper 422 is movably mounted on its opposite sidewalls of the cavity 21, the second button 41 is fixedly installed on the second stopper 422 and passes through its opposite of the cavity 21. One end of the first elastic member 6 is joined to the first stopper 322, the other end of the first elastic member 6 is joined to the second connecting part 423. One end of the second elastic member 7 is joined to the second stopper 422, the other end of the second elastic member 7 is joined to the first connecting part 323. The buckle hole 212 is fainted between the first connecting part 323 and the second connecting part 423. The connection portion 11 is inserted into the buckle hole 212 by passing through the insertion opening 211 and is locked by the first connecting part 323 and the second connecting part 423. The first button 31 and the second button 41 are simultaneously pressed, the first buckle member 32 and the second buckle are moved away from each other, its width of the buckle hole 212 is enlarged, the connection portion 11 is separated from the first connecting part 323 and the second connecting part 423.

As shown in FIG. 1 to FIG. 3, in another embodiment in the present invention, the connection portion 11 of the inserting buckle is passed through the insertion opening 211 and inserted into the buckle hole 212, then connected with the first connecting part 323 and the second connecting part 423, the insertion piece 1 is locked with the buckle body 2. The elastic force from the first elastic member 6 acts on the second connecting part 423, the elastic force from the second elastic member 7 acts on the first connecting part 323, both the second connecting part 423 and the first connecting part 323 are closely contact with both sides of the connection portion 11 to maintain a connection status. When the first button 31 and the second button 41 are simultaneously pressed, the first connecting part 323 and second connecting part 423 moves away from each other, then the connection portion 11 is separated from the first connecting part 323 and second connecting part 423, the ejection member 5 ejects the connection portion 11 out of the cavity 21, the insertion piece 1 is separated from the buckle body 2.

Figure 5:
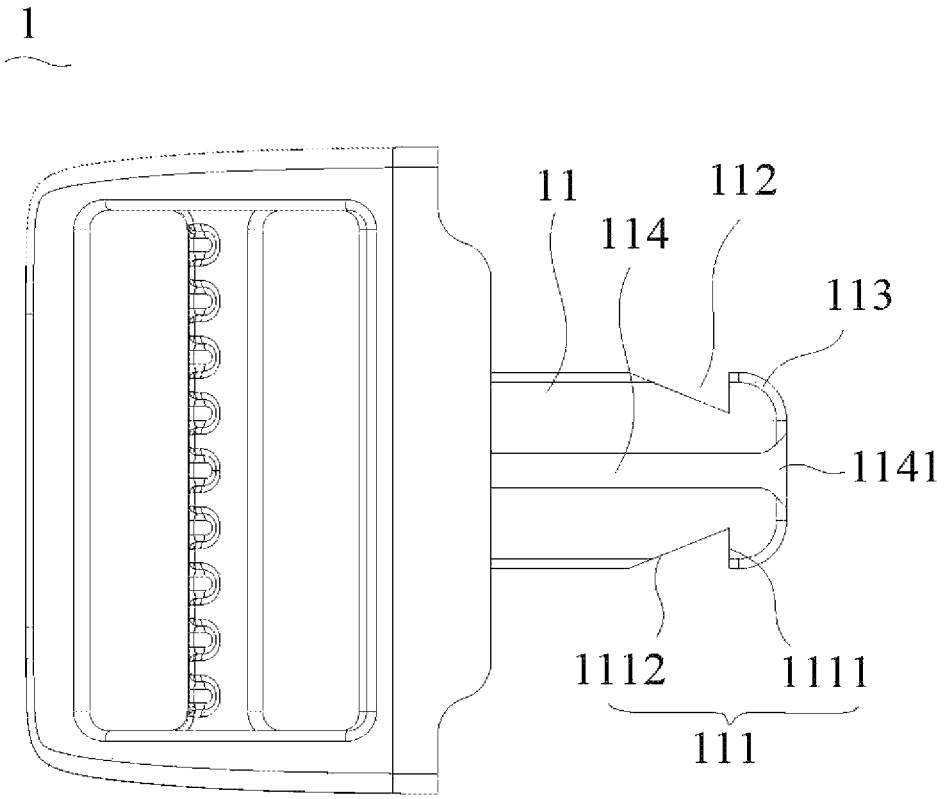
FIG. 5 shows a schematic diagram of the buckle body according to a preferred embodiment in present invention.

As shown in FIG. 1 and FIG. 5, in another embodiment in the present invention, the connection portion 11 of the inserting buckle is provided with a first buckle groove 111 on its one side and a second buckle groove 112 on its other side, both of the first buckle groove 111 and the second buckle groove 112 have a plane 1111 and an inclined plane 1112, the plane 1111 is perpendicular to its side edge of the connection portion 11. An angle is formed between the inclined plane 1112 and the plane 1111. Specifically, the object of above-mentioned design are as follow: After the connection portion 11 is connected with the first connecting part 323 and second connecting part 423, the connection portion 11 won't separate from the first connecting part 323 or the second connecting part 423 when the buckle body 1 is pulled, which has the advantages of firm connection.

As shown in FIG. 1 and FIG. 5, in another embodiment in the present invention, its internal surface of the first connecting part 323 is provided with a first buckle bulge portion 3231 matching with the first buckle groove 111. Its internal surface of the second connecting part 423 has a second bulge portion 4231 matching with the second buckle groove 112. Specifically, when the connection portion 11 is inserted into the buckle hole 212, both sides of the connection portion 11 are pressing the first connecting, part 323 and the second connecting part 423 to move outwards, then the first buckle bulge portion 3231 is embedded into the first buckle groove 111, the second bulge portion 4231 is embedded into the second buckle groove 112, the connection portion 11 is fixed in the buckle hole 212.

As shown in FIG. 1, in another embodiment of the present invention, its inside surface of the first stopper 322 is provided with a first positioning column 3221, its outside surface of the second connecting part 423 is provided with a second positioning column 4232, one end of the first elastic member 6 is sleeved on the first positioning column 3221, the other end of the first elastic member 6 is sleeved on the second positioning column 4232; its inside surface of the second stopper 422 is provided with a third positioning column 4221, its outside surface of the first buckle member 32 is provided with a fourth positioning column 3232, one end of the second elastic member 7 is sleeved on the third positioning column 4221, the other end of the second elastic member 7 is sleeved on the fourth positioning column 3232.

Specifically, the object of above-mentioned design is as follow: It's easy to install the first elastic member 6 and the second elastic member 7. The first elastic member 6 and the second elastic member 7 are precisely positioned during installation and never shifting during using.

Figure 4:
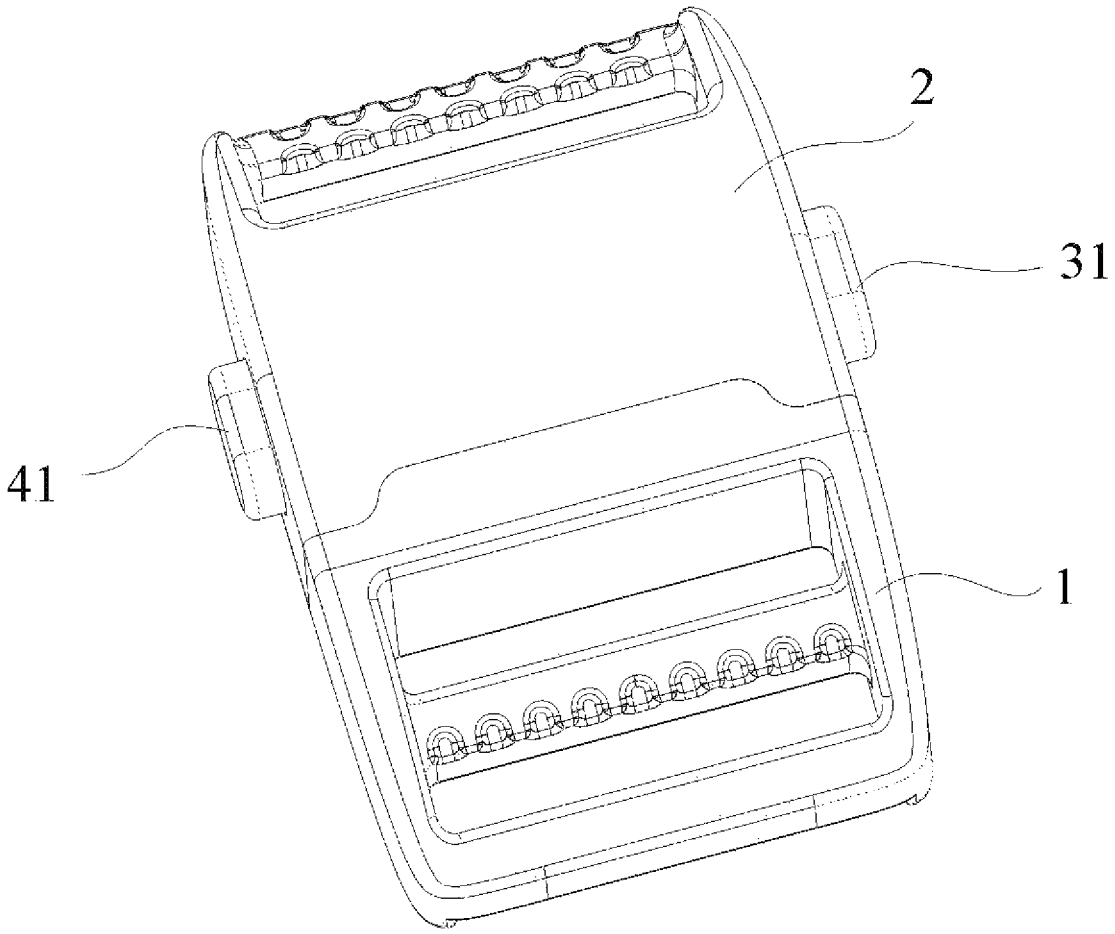
FIG. 4 shows a perspective view of the inserting buckle according to a preferred embodiment in present invention.
Figure 6:
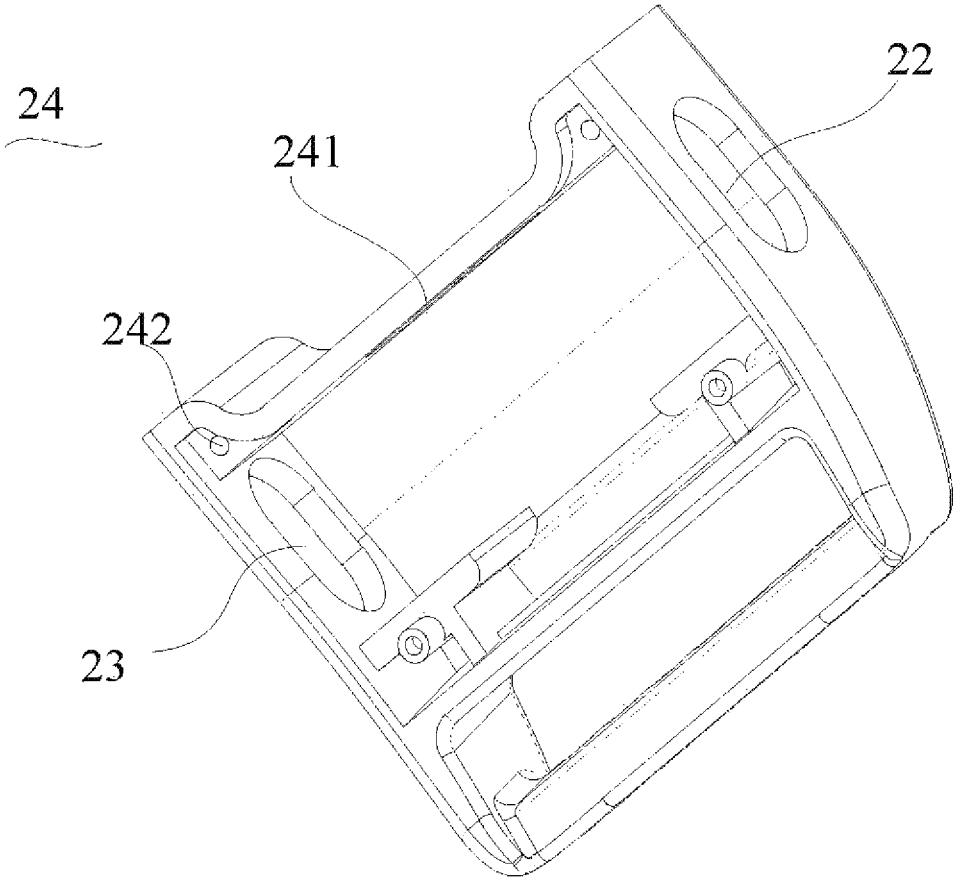
FIG. 6 shows a schematic diagram of the casing according to a preferred embodiment in present invention.

As shown in FIG. 4 and FIG. 6, in another embodiment of the present, invention, two opposite side walls of the buckle body 2 are provided with a first button hole 22 and a second button hole 23, respectively. The first button 31 passes through the first button hole 22, the first stopper 322 is limited in its inner side of the first button hole 22. The second button 41 passes through the second button hole 23, the second stopper 422 is limited in its inner side of the second button hole 23.

As shown in FIG. 3 and FIG. 6, in, another embodiment of the present invention, the buckle body 2 includes a casing 24 and a bottom cover 25, its bottom of the casing 24 is provided with an opening 241, the bottom cover 25 is covered on the opening 241, the bottom cover 25 is provided with a positioning column for installation 251 on its internal surface, the casing 24 is provided with a positioning hole 242 matching with the positioning column for installation 251. Specifically, the positioning column for installation 251 is inserted into the positioning hole 242 in the installation, which has a function of positioning and precise installation.

As shown in FIG. 3 and FIG. 5, in another embodiment of the present invention, its periphery of insertion opening 211 is provided with a guiding bump 2111; the connection portion 11 is provided with a guiding groove 114 matching with the guiding bump 2111. Specifically, when the connection portion 11 is inserted into the buckle hole 212, the guide groove 114 cooperates with the guide bump 2111, which has a function of guidance.

As shown in FIG. 1, in another embodiment in the present invention, both sides of the connection portion 11 are provided with a circular portion 113, respectively. Specifically, the function of the circular portion 113 is as follow:

The connection section 11 has less resistance and more smoothness when it is inserted into the buckle hole 212.

The above is only better embodiments in the invention and is not used to limit the invention. Any modification, equivalent replacement and improvement made within the spirit and principles of the invention shall be included in the protection of the invention.

What is claimed:

1. An inserting buckle, comprising an insertion piece with a connection portion;

wherein also comprising:

a buckle body, said buckle body has a cavity inside; said buckle body is provided with an insertion opening matching with said connection portion, said insertion opening is communicated with said cavity;

an ejection member, said ejection member is fixedly installed in said cavity and pointing at an inner surface of said insertion opening; when said connection portion is inserted into said cavity, said ejection member contacts with said connection portion;

a first pressing buckle, said first pressing buckle is movably disposed in said cavity and driven back by a first elastic member; and, a second pressing buckle, said second pressing buckle is movably disposed in said cavity and moved toward or away from said first pressing buckle; said second pressing buckle is driven back by a second elastic member; a buckle hole is formed between said first pressing buckle and said second pressing buckle; said connection portion is inserted into said cavity and is locked in said buckle hole; said first pressing buckle and said second pressing buckle are simultaneously pressed to enlarge a width of said buckle hole, said connection portion is separated from said buckle hole, said ejection member ejects said connection portion out of said cavity; when said first pressing buckle and said second pressing buckle are released, the first elastic member drives the first pressing buckle back, the second pressing buckle drives the second pressing buckle back, said width of said buckle hole is recovered;

wherein said first pressing buckle includes a first button and a first buckle member; said first buckle member includes a first sliding plate, a first stopper and a first connecting part; said first sliding plate is movably mounted inside said cavity, said first stopper is fixedly installed on one end of said first sliding plate, said first connecting part is fixedly installed on the other end of said first sliding plate; said second pressing buckle is inversely arranged on said first pressing buckle; said second pressing buckle includes a second button and a second buckle member; said second buckle member includes a second sliding plate, a second stopper and a second connecting part; said second sliding plate is movably mounted inside said cavity, the second stopper is fixedly installed on one end of said second sliding plate, said second connecting part fixedly installed on the other end of said second sliding plate.

2. The inserting buckle according to claim 1, wherein said first stopper, said second connecting part, said first connecting part and said second stopper are sequentially arranged; the first stopper is movably mounted on a side wall of said cavity, said first button is fixedly installed on said first stopper and passes through said sidewall of said cavity; said second stopper is movably mounted on said second stopper and passes through an opposite sidewall of said cavity; one end of said first elastic member is joined to said first stopper, the other end of said first elastic member is joined to said second connecting part; one end of said second elastic member is joined to said second stopper, the other end of said second elastic member is joined to said first connecting part; said buckle hole is formed between said first connecting part and said second connecting part; said connection portion is inserted into said buckle hole by passing through said insertion opening and is locked by said first connecting part and said second connecting part; said first button and said second button are simultaneously pressed, said first buckle member and said second buckle are moved away from each other, said width of said buckle hole is enlarged, said connection portion is separated from said first connecting part and said second connecting part.

3. The inserting buckle according to claim 1, wherein said connection portion is provided with a first buckle groove on one side and a second buckle groove on the other side, both of said first buckle groove and said second buckle groove have a plane and an inclined plane, said plane is perpendicular to a side edge of said connection portion; an angle is formed between said inclined plane and said plane.

4. The insert buckle according to claim 2, wherein said connection portion is provided with a first buckle groove on one side and a second buckle groove on the other side, both of said first buckle groove and said second buckle groove have a plane and an inclined plane, said plane is perpendicular to a side edge of said connection portion; an angle is formed between said inclined plane and said plane.

5. The inserting buckle according to claim 3, wherein an internal surface of said first connecting part is provided with a first buckle bulge portion matching with said first buckle groove; an internal surface of said second connecting part is provided with a second bulge portion matching with said second buckle groove.

6. The inserting buckle according to claim 1, wherein an inside surface of said first stopper is provided with a first positioning column, an outside surface of said second connecting part is provided with a second positioning column, one end of said first elastic member is sleeved on said first positioning column, the other end of said first elastic member is sleeved on said second positioning column; an inside surface of said second stopper is provided with a third positioning column, an outside surface of said first buckle member is provided with a fourth positioning column, one end of said second elastic member is sleeved on said third positioning column, the other end of said second elastic member is sleeved on said fourth positioning column.

7. The inserting buckle according to claim 2, wherein an inside surface of said first stopper is provided with a first positioning column, an outside surface of said second connecting part is provided with a second positioning column, one end of said first elastic member is sleeved on said first positioning column, the other end of said first elastic member is sleeved on said second positioning column; an inside surface of said second stopper is provided with a third positioning column, an outside surface of said first buckle member is provided with a fourth positioning column, one end of said second elastic member is sleeved on said third positioning column, the other end of said second elastic member is sleeved on said fourth positioning column.

8. The inserting buckle according to claim 1, wherein two opposite side walls of said buckle body are provided with a first button hole and a second button hole, respectively; said first button passes through said first button hole, said first stopper is limited on an inner side of said first button hole;

said second button passes through said second button hole, said second stopper is limited on an inner side of said second button hole.

9. The inserting buckle according to claim 2, wherein two opposite side walls of said buckle body are provided with a first button hole and a second button hole, respectively; said first button passes through said first button hole, said first stopper is limited on an inner side of said first button hole; said second button passes through said second button hole, said second stopper is limited on an inner side of said second button hole.

10. The inserting buckle according to claim 1, wherein said buckle body includes a casing and a bottom cover, a bottom of said casing is provided with an opening, said bottom cover is covered on said opening, said bottom cover is provided with a positioning column for installation on an internal surface, the casing is provided with a positioning hole matching with said positioning column for installation.

11. The inserting buckle according to claim 2, wherein said buckle body includes a casing and a bottom cover, a bottom of said casing is provided with an opening, said bottom cover is covered on said opening, said bottom cover is provided with a positioning column for installation on an internal surface, said casing is provided with a positioning hole matching with said positioning column for installation.

12. The inserting buckle according to claim 5, wherein said buckle body includes a casing and a bottom cover, a bottom of said casing is provided with an opening, said bottom cover is covered on said opening, said bottom cover is provided with a positioning column for installation on an internal surface, the casing is provided with a positioning hole matching with said positioning column for installation.

13. The inserting buckle according to claim 1, wherein a periphery of insertion opening is provided with a guiding bump; said connection portion is provided with a guiding groove matching with said guiding bump.

14. The inserting buckle according to claim 2, wherein a periphery of insertion opening is provided with a guiding bump; said connection portion is provided with a guiding groove matching with said guiding bump.

15. The inserting buckle according to claim 1, wherein both sides of said connection portion are provided with a circular portion, respectively.

16. The inserting buckle according to claim 2, wherein both sides of said connection portion are provided with a circular portion, respectively.

* * * * *